US007838709B2

(12) United States Patent
Matsui et al.

(10) Patent No.: US 7,838,709 B2
(45) Date of Patent: Nov. 23, 2010

(54) LUBRICATING BASE OIL AND LUBRICATING OIL COMPOSITION

(75) Inventors: Shigeki Matsui, Yokohama (JP); Akira Yaguchi, Yokohama (JP); Kazuo Tagawa, Yokohama (JP); Shinichi Shirahama, Yokohama (JP)

(73) Assignees: Nippon Oil Corporation, Tokyo (JP); Petroleum Energy Center, Tokyo (JP)

( * ) Notice: Subject to any disclaimer, the term of this patent is extended or adjusted under 35 U.S.C. 154(b) by 0 days.

(21) Appl. No.: 11/822,408

(22) Filed: Jul. 5, 2007

(65) Prior Publication Data

US 2008/0015400 A1 Jan. 17, 2008

(30) Foreign Application Priority Data

Jul. 6, 2006 (JP) ..... P2006-187074

(51) Int. Cl.
*C07C 7/20* (2006.01)
*C10L 1/16* (2006.01)
*C10G 73/06* (2006.01)

(52) U.S. Cl. ..... 585/1; 585/9; 585/13; 508/111; 208/33; 208/40

(58) Field of Classification Search ..... 508/111; 585/1, 6.6, 9, 13; 208/33, 34, 40, 41
See application file for complete search history.

(56) References Cited

U.S. PATENT DOCUMENTS

| | | | | |
|---|---|---|---|---|
| 6,090,989 | A * | 7/2000 | Trewella et al. | 585/13 |
| 2005/0077209 | A1* | 4/2005 | Miller et al. | 208/96 |
| 2005/0241990 | A1* | 11/2005 | Ziemer et al. | 208/19 |
| 2006/0113216 | A1* | 6/2006 | Rosenbaum et al. | 208/27 |

FOREIGN PATENT DOCUMENTS

| | | |
|---|---|---|
| JP | 4-036391 | 2/1992 |
| JP | 4-068082 | 3/1992 |
| JP | 4-120193 | 4/1992 |

* cited by examiner

*Primary Examiner*—Glenn A Caldarola
*Assistant Examiner*—Vishal Vasisth
(74) *Attorney, Agent, or Firm*—Finnegan, Henderson, Farabow, Garrett & Dunner, LLP

(57) ABSTRACT

The invention provides a lubricating base oil with a saturated component content of 90% by mass or greater, a proportion of cyclic saturated components of no greater than 40% by mass of the saturated components, a viscosity index of 110 or greater, an aniline point of 106 or greater and an ϵ-methylene proportion of 14-20% of the total constituent carbons, as well as a lubricating oil composition comprising the lubricating base oil.

14 Claims, No Drawings

LUBRICATING BASE OIL AND LUBRICATING OIL COMPOSITION

BACKGROUND OF THE INVENTION

1. Field of the Invention

The present invention relates to a lubricating base oil and a lubricating oil composition.

2. Related Background Art

In the field of lubricating oils, it has been attempted to improve lubricating oil properties such as the viscosity-temperature characteristic and heat and oxidation stability by addition of additives to the lubricating base oils such as highly refined mineral oils (for example, see Japanese Unexamined Patent Publication HEI No. 4-36391, Japanese Unexamined Patent Publication HEI No. 4-68082, Japanese Unexamined Patent Publication HEI No. 4-120193).

SUMMARY OF THE INVENTION

However, with ever increasing demands on the properties of lubricating oils in recent times, it cannot be said that the lubricating base oils described in the aforementioned patent documents are always satisfactory in terms of viscosity-temperature characteristic and heat and oxidation stability. In particular, with SAE10 class lubricating base oils and lubricating oil compositions containing them as major components it is difficult to achieve both a high viscosity index and a superior level of low temperature viscosity (CCS viscosity, MRV viscosity, Brookfield (BF) viscosity, etc.) at −35° C. and below, and they must therefore be used in combination of lubricating base oils that exhibit excellent low temperature viscosity such as synthetic base oils like poly-α-olefins or esters and low-viscosity mineral base oils. However, such synthetic oils are expensive, while low-viscosity mineral base oils generally have low viscosity indexes and high NOACK evaporation, and therefore addition of such lubricating base oils increases the lubricating oil manufacturing cost and makes it difficult to achieve a high viscosity index and low evaporation. Furthermore, there have been limits to the improvement in the properties by the use of such conventional lubricating base oils and additives in combination.

The present invention has been accomplished in light of these circumstances, and its object is to provide a lubricating base oil, and a lubricating oil composition comprising the lubricating base oil, which exhibit excellent viscosity-temperature characteristics and heat and oxidation stability, and which can exhibit a high viscosity index and low temperature viscosity properties at −35° C. and below without using synthetic oils such as poly-α-olefins or esters or low-viscosity mineral base oils, and especially which allow notable improvement in the MRV viscosity of lubricating oils at −40° C.

In order to solve the problems described above, the invention provides a lubricating base oil with a saturated component content of 95% by mass or greater, a cyclic saturated component proportion of no greater than 40% by mass of the saturated components, a viscosity index of 110 or greater, an aniline point of 106 or greater, and an ϵ-methylene proportion of 14-20% of the total constituent carbons.

If the saturated component content, the proportion of cyclic saturated components in the saturated components, the viscosity index, the aniline point and the proportion of ϵ-methylene of the total constituent carbons (this will hereinafter also be referred to simply as "ϵ-methylene proportion") in the lubricating base oil of the invention satisfy the conditions described above, it is possible to achieve an excellent viscosity-temperature characteristic and heat and oxidation stability. With the lubricating base oil of the invention it is possible to achieve both a high viscosity index of 130 or higher and a low temperature viscosity at −35° C. and below, and in particular it is possible to notably reduce the MRV viscosity at −40° C. Moreover, when additives have been added to the lubricating base oil, an even higher level of function can be exhibited by the additives while maintaining satisfactorily stable dissolution of the additives in the lubricating base oil.

The lubricating base oil of the invention can also lower the viscous resistance and stirring resistance in a practical temperature range due to the aforementioned excellent viscosity-temperature characteristic, and thereby maximize the effect obtained by addition of friction modifiers and the like. Thus, the lubricating base oil of the invention reduces energy loss in devices in which the lubricating base oil is used, and is therefore extremely useful for achieving energy savings.

The invention further provides a lubricating oil composition comprising the aforementioned lubricating base oil of the invention.

The lubricating oil composition of the invention comprises a lubricating base oil according to the invention and therefore exhibits a high level for both the viscosity-temperature characteristic and heat and oxidation stability, while exhibiting a high viscosity index and a low temperature viscosity property at −35° C. and below without using synthetic oils such as poly-α-olefins, esters and low-viscosity mineral base oils, and in particular it allows notable improvement in the MRV viscosity of lubricating oils at −40° C.

DESCRIPTION OF THE PREFERRED EMBODIMENTS

Preferred embodiments of the invention will now be described in detail.

The lubricating base oil of the invention is a lubricating base oil with a saturated component content of 90% by mass or greater, a proportion of cyclic saturated components of no greater than 40% by mass of the saturated components, a viscosity index of 110 or greater, an aniline point of 106 or greater and an ϵ-methylene proportion of 14-20% of the total constituent carbons.

The lubricating base oil of the invention is not particularly restricted so long as the saturated component content, the proportion of cyclic saturated components in the saturated components, the viscosity index, the aniline point and the ϵ-methylene proportion in the lubricating base oil of the invention satisfy the conditions described above. Specifically, there may be paraffinic mineral oils prepared by subjecting lube-oil distillates obtained by atmospheric distillation and/or vacuum distillation of crude oil to refining involving one or a combination of refining treatments such as solvent deasphalting, solvent extraction, hydrocracking, solvent dewaxing, catalytic dewaxing, hydrorefining, sulfuric acid treatment and white clay treatment, or normal paraffin base oils or isoparaffin base oils, which satisfy the conditions described above for the saturated component content, the proportion of cyclic saturated components in the saturated components, the viscosity index, the aniline point and the ϵ-methylene proportion in the lubricating base oil. Such lubricating base oils may be used alone, or a combination of two or more thereof may be used.

As preferred examples of lubricating base oils according to the invention there may be mentioned base oils obtained by using the following base oils (1)-(8) as feed stock oils, carrying out prescribed refining processes to refine the feed stock oils and/or lube-oil distillates recovered from the feed stock oils, and recovering the lube-oil distillates.

(1) Distilled oil from atmospheric distillation of paraffinic crude oil and/or mixed-base crude oil.

(2) Distilled oil obtained by vacuum distillation of the residue from atmospheric distillation of paraffinic crude oil and/or mixed-base crude oil (WVGO).

(3) Wax obtained by a lubricating oil dewaxing step (slack wax or the like) and/or synthetic wax obtained by a gas-to-liquid (GTL) process (Fischer-Tropsch wax, GTL wax or the like).

(4) Blended oil comprising one or more selected from among base oils (1)-(3) and/or mildly hydrocracked oil obtained from the blended oil.

(5) Blended oil comprising two or more selected from among base oils (1)-(4).

(6) Deasphalted oil (DAO) from base oil (1), (2), (3), (4) or (5).

(7) Mildly hydrocracked oil (MHC) obtained from base oil (6).

(8) Blended oil comprising two or more selected from base oils (1)-(7).

The prescribed refining process described above is preferably hydrorefining such as hydrocracking or hydrofinishing; solvent refining such as furfural solvent extraction; dewaxing such as solvent dewaxing or catalytic dewaxing; white clay refining with acidic white clay or active white clay, or chemical (acid or alkali) washing such as sulfuric acid treatment or caustic soda washing. According to the invention, any one of these refining processes may be used alone, or a combination of two or more thereof may be used in combination. When a combination of two or more refining processes is used, the order is not particularly restricted and may be selected as appropriate.

The lubricating base oil of the invention is most preferably one of the following base oils (9) or (10) obtained by the prescribed treatment of a base oil selected from among base oils (1)-(8) above or a lube-oil distillate recovered from the base oil.

(9) Hydrocracked mineral oil obtained by hydrocracking of a base oil selected from among base oils (1)-(8) above or a lube-oil distillate recovered from the base oil, dewaxing treatment such as solvent dewaxing or catalytic dewaxing of the product or a lube-oil distillate recovered from distillation of the product, or further distillation after the dewaxing treatment.

(10) Hydroisomerized mineral oil obtained by hydroisomerization of a base oil selected from among base oils (1)-(8) above or a lube-oil distillate recovered from the base oil, and dewaxing treatment such as solvent dewaxing or catalytic dewaxing of the product or a lube-oil distillate recovered from distillation of the product, or further distillation after the dewaxing treatment.

In obtaining the lubricating base oil of (9) or (10) above, a solvent refining treatment and/or hydrofinishing treatment step may also be carried out in a convenient manner if necessary.

There are no particular restrictions on the catalyst used for the hydrocracking and hydroisomerization, but there may be suitably used hydrocracking catalysts comprising a hydrogenating metal (for example, one or more metals of Group Via or metals of Group VIII of the Periodic Table) loaded on a carrier which is a complex oxide with decomposing activity (for example, silica-alumina, alumina-boria, silica-zirconia or the like) or a combination of two or more of such complex oxides bound with a binder, or hydroisomerization catalysts obtained by loading one or more metals of Group VIII having hydrogenating activity on a carrier comprising zeolite (for example, ZSM-5, zeolite beta, SAPO-11 or the like). The hydrocracking catalyst or hydroisomerization catalyst may be used as a combination of layers or a mixture.

The reaction conditions for hydrocracking and hydroisomerization are not particularly restricted, but preferably the hydrogen partial pressure is 0.1-20 MPa, the mean reaction temperature is 150-450° C., the LHSV is 0.1-3.0 $hr^{-1}$ and the hydrogen/oil ratio is 50-20,000 scf/bbl.

The following production process A may be mentioned as a preferred example of a production process for the lubricating base oil of the invention.

Specifically, production process A according to the invention comprises a first step of preparing a hydrocracking catalyst comprising a carrier having an $NH_3$ desorption percentage at 300-800° C. of no greater than 80% with respect to the total $NH_3$ desorption, based on $NH_3$ desorption temperature dependence evaluation, and at least one metal from among metals of Group Via and at least one metal from among metals of Group VIII of the Periodic Table supported on the carrier, a second step of hydrocracking of a feed stock oil comprising at least 50 vol % slack wax in the presence of a hydrocracking catalyst, at a hydrogen partial pressure of 0.1-14 MPa, a mean reaction temperature of 230-430° C., an LHSV of 0.3-3.0 $hr^{-1}$ and a hydrogen/oil ratio of 50-14,000 scf/bbl, a third step of distilling separation of the cracked product oil obtained in second step to obtain a lube-oil distillate, and a fourth step of dewaxing treatment of the lube-oil distillate obtained in third step.

Production process A will now be explained in detail.

(Feed Stock Oil)

For production process A, a stock oil comprising at least 50 vol % slack wax is used. The phrase "stock oil comprising at least 50 vol % slack wax" according to the invention refers to both feed stock oils composed entirely of slack wax, and stock oil that is a blended oil of slack wax and another stock oil and comprises at least 50 vol % slack wax.

Slack wax is the wax-containing component as a by-product of the solvent dewaxing step during production of a lubricating base oil from a paraffinic lube-oil distillate, and according to the invention the term includes slack wax obtained by further subjecting the wax-containing component to deoiling treatment. The major components of slack wax are n-paraffins and branched paraffins with few side chains (isoparaffins), and the naphthene and aromatic component contents are low. The kinematic viscosity of the slack wax used for preparation of the stock oil may be selected as appropriate for the kinematic viscosity of the lubricating base oil to be obtained, but for production of a low-viscosity base oil as a lubricating base oil for the invention, a relatively low viscosity slack wax is preferred, with a 100° C. kinematic viscosity of about 2-25 $mm^2/s$, preferably 2.5-20 $mm^2/s$ and more preferably 3-15 $mm^2/s$.

The other properties of the slack wax may be as desired, although the melting point is preferably 35-80° C., more preferably 45-70° C. and even more preferably 50-60° C. The oil content of the slack wax is preferably no greater than 60% by mass, more preferably no greater than 50% by mass, even more preferably no greater than 25% by mass and most preferably no greater than 10% by mass, while also preferably 0.5% by mass or greater and more preferably 1% by mass or greater. The sulfur content of the slack wax is preferably no greater than 1% by mass and more preferably no greater than 0.5% by mass, while also preferably 0.001% by mass or greater.

The oil content of the thoroughly deoiled slack wax (hereinafter referred to as "slack wax A") is preferably 0.5-10% by mass and more preferably 1-8% by mass. The sulfur content of slack wax A is preferably 0.001-0.2% by mass, more preferably 0.01-0.15% by mass and even more preferably 0.05-0.12% by mass. However, the oil content of slack wax that has either not been subjected to deoiling treatment or has been subjected only to insufficient deoiling treatment (hereinafter, "slack wax B") is preferably 10-60% by mass, more preferably 12-50% by mass and even more preferably 15-25% by mass. The sulfur content of slack wax B is preferably 0.05-1% by mass, more preferably 0.1-0.5% by mass and even more preferably 0.15-0.25% by mass. These slack waxes A and B may be desulfurized depending on the type and properties of the hydrocracking/isomerization catalyst, in which case the sulfur content is preferably no greater than 0.01% by mass and more preferably no greater than 0.001% by mass.

The invention is highly useful as it allows high added-value lubricating base oils with high viscosity indexes as well as excellent low-temperature characteristics and heat and oxidation stability, to be obtained even when the feed stock oils used are relatively crude and cheap slack waxes with relatively high oil and sulfur contents.

When the stock oil is a blended oil comprising a slack wax and another stock oil, the other stock oil is not particularly restricted so long as it has a slack wax content of 50 vol % or greater of the total blended oil, but preferably a blended oil comprising a heavy atmospheric distilled oil and/or a vacuum distilled oil from crude oil is used.

When the stock oil is a blended oil comprising slack wax and another stock oil, the proportion of slack wax in the total blended oil is preferably at least 70 vol % and more preferably at least 75 vol %, from the standpoint of producing a base oil with a high viscosity index. If the proportion is less than 50 vol %, the oil components such as aromatic and naphthene components will be increased in the obtained lubricating base oil, and the viscosity index of the lubricating base oil will tend to be reduced.

On the other hand, the heavy atmospheric distilled oil and/or vacuum distilled oil from crude oil which is used with the slack wax is preferably a fraction with a run-off of at least 60 vol % in a distillation temperature range of 300-570° C., in order to maintain a high viscosity index for the lubricating base oil product.

(Hydrocracking Catalyst)

The hydrocracking catalyst used in production process A described above comprises at least one metal from among metals of Group VIa and at least one metal from among metals of Group VIII of the Periodic Table, supported on a carrier with an $NH_3$ desorption percentage at 300-800° C. of no greater than 80% with respect to the total $NH_3$ desorption, based on $NH_3$ desorption temperature dependence evaluation.

The "$NH_3$ desorption temperature dependence evaluation" referred to here is the method described in the literature (Sawa M., Niwa M., Murakami Y, Zeolites 1990, 10, 532; Karge H. G., Dondur V, J. Phys. Chem. 1990, 94, 765 and elsewhere), and it is carried out as follows. First, the catalyst carrier is pretreated under a nitrogen stream for at least 30 minutes at a temperature of 400° C. or higher to remove the adsorbed molecules, and then adsorption is carried out at 100° C. until neutralization of the $NH_3$. Next, the temperature of the catalyst carrier is raised to 100-800° C. at a temperature-elevating rate of no more than 10° C./min for $NH_3$ desorption, and the $NH_3$ separated by desorption is monitored at each prescribed temperature. The desorption percentage of $NH_3$ at 300° C.-800° C. with respect to the total $NH_3$ desorption (desorption at 100-800° C.) is then calculated.

The catalyst carrier used for production process A has an $NH_3$ desorption percentage at 300-800° C. of no greater than 80% with respect to the total $NH_3$ desorption based on $NH_3$ desorption temperature dependence evaluation, and it is preferably no greater than 70% and more preferably no greater than 60%. By using such a carrier to construct the hydrocracking catalyst, acidic substances that govern the cracking activity are sufficiently inhibited, so that it is possible to efficiently and reliably produce isoparaffins by decomposing isomerization of high-molecular-weight n-paraffins that derive from the slack wax in the stock oil by hydrocracking, and to satisfactorily inhibit excess cracking of the produced isoparaffin compounds. As a result, it is possible to obtain a sufficient amount of molecules with a high viscosity index having a suitably branched chemical structure, within a suitable molecular weight range.

As such carriers there are preferred two-element oxides which are amorphous and acidic, and as examples there may be mentioned the two-element oxides cited in the literature (for example, "Metal Oxides and Their Catalytic Functions", Shimizu, T., Kodansha, 1978).

Preferred among these are amorphous complex oxides that contain acidic two-element oxides obtained as complexes of two oxides of elements selected from among Al, B, Ba, Bi, Cd, Ga, La, Mg, Si, Ti, W, Y, Zn and Zr. The proportion of each oxide in such acidic two-element oxides can be adjusted to obtain an acidic carrier suitable for the purpose in the aforementioned $NH_3$ adsorption/desorption evaluation. The acidic two-element oxide composing the carrier may be any one of the above, or a mixture of two or more thereof. The carrier may also be composed of the aforementioned acidic two-element oxide, or it may be a carrier obtained by binding the acidic two-element oxide with a binder.

The carrier is preferably one containing at least one acidic two-element oxide selected from among amorphous silica-alumina, amorphous silica-zirconia, amorphous silica-magnesia, amorphous silica-titania, amorphous silica-boria, amorphous alumina-zirconia, amorphous alumina-magnesia, amorphous alumina-titania, amorphous alumina-boria, amorphous zirconia-magnesia, amorphous zirconia-titania, amorphous zirconia-boria, amorphous magnesia-titania, amorphous magnesia-boria and amorphous titania-boria. The acidic two-element oxide composing the carrier may be any one of the above, or a mixture of two or more thereof. The carrier may also be composed of the aforementioned acidic two-element oxide, or it may be a carrier obtained by binding the acidic two-element oxide with a binder. The binder is not particularly restricted so long as it is one commonly used for catalyst preparation, but those selected from among silica, alumina, magnesia, titania, zirconia and clay, or mixtures thereof, are preferred.

For production process A, the hydrocracking catalyst has a structure wherein at least one metal of Group VIa of the Periodic Table (molybdenum, chromium, tungsten or the like) and at least one metal of Group VIII (nickel, cobalt, palladium, platinum or the like) are loaded on the aforementioned carrier. These metals have a hydrogenating function, and on the acidic carrier they complete a reaction which causes cracking or branching of the paraffin compound, thus performing an important role for production of isoparaffins with a suitable molecular weight and branching structure.

As regards the loading amounts of the metals in the hydrocracking catalyst, the loading amount of metals of Group VIa is preferably 5-30% by mass for each metal, and the loading amount of metals of Group VIII is preferably 0.2-10% by mass for each metal.

The hydrocracking catalyst used for production process A more preferably comprises molybdenum in a range of 5-30% by mass as the one or more metals of Group Via, and nickel in a range of 0.2-10% by mass as the one or more metals of Group VIII.

The hydrocracking catalyst composed of the carrier, at least one metal of Group VIa and at least one metal of Group VIII is preferably used in a sulfurized state for hydrocracking. The sulfurizing treatment may be carried out by a publicly known method.

(Hydrocracking Step)

For production process A, the stock oil containing at least 50 vol % slack wax is hydrocracked in the presence of the hydrocracking catalyst, at a hydrogen partial pressure of 0.1-14 MPa, preferably 1-14 MPa and more preferably 2-7 MPa; a mean reaction temperature of 230-430° C., preferably 330-400° C. and more preferably 350-390° C.; an LHSV of 0.3-3.0 $hr^{-1}$ and preferably 0.5-2.0 $hr^{-1}$ and a hydrogen/oil ratio of 50-14,000 scf/bbl and preferably 100-5000 scf/bbl.

In the hydrocracking step, the n-paraffins derived from the slack wax in the stock oil are isomerized to isoparaffins during cracking, producing isoparaffin components with a low pour point and a high viscosity index, but it is possible to simultaneously decompose the aromatic compounds in the stock oil, which disturb increasing the viscosity index, to monocyclic aromatic compounds, naphthene compounds and paraffin compounds, and to decompose the polycyclic naphthene compounds which disturb increasing viscosity index to monocyclic naphthene compounds or paraffin compounds. From the viewpoint of increasing the viscosity index, it is preferred to minimize the high boiling point and low viscosity index compounds in the stock oil.

If the cracking severity as an evaluation of the extent of reaction is defined by the following formula:

(cracking severity (vol %))=100−(proportion (vol %) of fraction with boiling point of 360° C. or higher in product)

then the cracking severity is preferably 3-90 vol %. A cracking severity of less than 3 vol % is not preferred because it will result in insufficient production of isoparaffins by decomposing isomerization of high-molecular-weight n-paraffins with a high pour point in the stock oil and insufficient hydrocracking of the aromatic or polycyclic naphthene components with an inferior viscosity index, while a cracking severity of greater than 90 vol % is not preferred because it will reduce the lube-oil distillate yield.

(Distilling Separation Step)

The lube-oil distillate is then subjected to distilling separation from the cracked product oil obtained from the hydrocracking step described above. A fuel oil fraction is also sometimes obtained as the light fraction.

The fuel oil fraction is the fraction obtained as a result of thorough desulfurization and denitrogenization, and thorough hydrogenation of the aromatic components. The naphtha fraction with a high isoparaffin content, the kerosene fraction with a high smoke point and the gas oil fraction with a high cetane number are all high quality products suitable as fuel oils.

On the other hand, even with insufficient hydrocracking of the lube-oil distillate, a portion thereof may be supplied for repeat of the hydrocracking step. In order to obtain a lube-oil distillate with the desired kinematic viscosity, the lube-oil distillate may then be subjected to vacuum distillation. The vacuum distillation separation may be carried out after the dewaxing treatment described below.

In the evaporating separation step, the cracked product oil obtained from the hydrocracking step may be subjected to vacuum distillation to satisfactorily obtain a lubricating base oil such as 70 Pale, SAE10 and SAE20.

A system using a lower viscosity slack wax as the stock oil is suitable for producing an increased 70 Pale or SAE10 fraction, while a system using a high viscosity slack wax in the range mentioned above as the stock oil is suitable for obtaining more SAE20. However even with high viscosity slack wax, conditions for producing significant amounts of 70 Pale and SAE10 may be selected depending on the extent of the cracking reaction.

(Dewaxing Step)

The lube-oil distillate obtained by fractional distillation from the cracked product oil in the distilling separation step has a high pour point, and therefore dewaxing is carried out to obtain a lubricating base oil with the desired solid point. The dewaxing treatment may be carried out by an ordinary method such as a solvent dewaxing method or catalytic dewaxing method. Solvent dewaxing methods generally employ MEK and toluene mixed solvents, but solvents such as benzene, acetone or MIBK may also be used. In order to improve the low temperature viscosity property of the dewaxing oil from the obtained SAE10 class fraction, the solvent/oil ratio is preferably 1-6, and the filtration temperature is preferably no higher than −25° C., more preferably −26 to −45° C., even more preferably −27 to −40° C. and most preferably −28 to −35° C. The wax removed by filtration may be supplied again as slack wax to a hydrocracking step.

The production process described above may also include solvent refining treatment and/or hydrorefining treatment in addition to the dewaxing treatment. Such additional treatment is performed to improve the ultraviolet stability or oxidation stability of the lubricating base oil, and may be carried out by methods ordinarily used for lubricating oil refining steps.

The solvent used for solvent refining will usually be furfural, phenol, N-methylpyrrolidone or the like, in order to remove the small amounts of aromatic compounds and especially polycyclic aromatic compounds, remaining in the lube-oil distillate.

The hydrorefining is carried out for hydrogenation of the olefin compounds and aromatic compounds, and the catalyst therefor is not particularly restricted; there may be used alumina catalysts supporting at least one metal from among Group VIa metals such as molybdenum and at least one metal from among Group VIII metals such as cobalt and nickel, under conditions with a reaction pressure (hydrogen partial pressure) of 7-16 MPa, a mean reaction temperature of 300-390° C. and an LHSV of 0.5-4.0 $hr^{-1}$.

The following production process B may be mentioned as another preferred example of a production process for the lubricating base oil of the invention.

Specifically, production process B according to the invention comprises a fifth step of hydrocracking and/or hydroisomerization of a stock oil containing paraffinic hydrocarbons in the presence of a catalyst, and a sixth step of dewaxing treatment of the product obtained from the fifth step or of the lube-oil distillate collected by distillation or the like from the product.

Production process B will now be explained in detail.

(Stock Oil)

For production process B there is used a stock oil containing paraffinic hydrocarbons. The term "paraffinic hydrocarbons" according to the invention refers to hydrocarbons with a paraffin molecule content of 70% by mass or greater. The number of carbons of the paraffinic hydrocarbons is not particularly restricted but will normally be about 10-100. The method for producing the paraffinic hydrocarbons is not particularly restricted, and various petroleum-based and synthetic paraffinic hydrocarbons may be used, but as especially preferred paraffinic hydrocarbons there may be mentioned synthetic waxes (Fischer-Tropsch wax (FT wax), GTL wax, etc.) obtained by gas-to-liquid (GTL) processes, among which FT wax is preferred. Synthetic wax is preferably wax composed mainly of normal paraffins with 15-80 and more preferably 20-50 carbon atoms.

The kinematic viscosity of the paraffinic hydrocarbons used for preparation of the stock oil may be appropriately selected according to the desired kinematic viscosity of the lubricating base oil, but for production of a low-viscosity base oil as a lubricating base oil of the invention, relatively low viscosity paraffinic hydrocarbons with a 100° C. kinematic viscosity of about 2-25 $mm^2/s$, preferably about 2.5-20 $mm^2/s$ and more preferably about 3-15, are preferred. The other properties of the paraffinic hydrocarbons may be as desired, but when the paraffinic hydrocarbons are synthetic wax such as FT wax, the melting point is preferably 35-80° C., more preferably 50-80° C. and even more preferably 60-80° C. The oil content of the synthetic wax is preferably no greater than 10% by mass, more preferably no greater than 5% by mass and even more preferably no greater than 2% by mass. The sulfur content of the synthetic wax is preferably no greater than 0.01% by mass, more preferably no greater than 0.001% by mass and even more preferably no greater than 0.0001% by mass.

When the stock oil is a blended oil comprising the aforementioned synthetic wax and another stock oil, the other stock oil is not particularly restricted so long as it has a synthetic wax proportion of at least 50 vol % of the total blended oil, but it is preferably a blended oil comprising a heavy atmospheric distilled oil and/or a vacuum distilled oil from crude oil.

When the stock oil is a blended oil comprising the synthetic wax and another stock oil, the proportion of synthetic wax of the total blended oil is preferably at least 70 vol % and more preferably at least 75 vol %, from the standpoint of producing a base oil with a high viscosity index. If the proportion is less than 70 vol %, the oil components such as aromatic and naphthene components will be increased in the obtained lubricating base oil, and the viscosity index of the lubricating base oil will tend to be reduced.

On the other hand, the heavy atmospheric distilled oil and/or vacuum distilled oil from crude oil which is used with the synthetic wax is preferably a fraction with a run-off of at least 60 vol % in a distillation temperature range of 300-570° C., in order to maintain a high viscosity index for the lubricating base oil product.

(Catalyst)

There are no particular restrictions on the catalyst used for production process B, but it is preferably a catalyst comprising at least one metal selected from metals of Group VIb and Group VIII of the Periodic Table as an active metal component supported on a carrier containing an aluminosilicate.

An aluminosilicate is a metal oxide composed of the three elements aluminum, silicon and oxygen. Other metal elements may also be included in ranges that do not interfere with the effect of the invention. In this case, the amount of other metal elements is preferably no greater than 5% by mass and more preferably no greater than 3% by mass of the total of alumina and silica in terms of their oxides. As examples of metal elements that may be included there may be mentioned titanium, lanthanum and manganese.

The crystallinity of the aluminosilicate can be estimated by the proportion of tetracoordinated aluminum atoms among the total aluminum atoms, and the proportion can be measured by $^{27}Al$ solid NMR. The aluminosilicate used for the invention has a tetracoordinated aluminum proportion of preferably at least 50% by mass, more preferably at least 70% by mass and even more preferably at least 80% by mass of the total aluminum. Aluminosilicates with tetracoordinated aluminum contents of greater than 50% by mass of the total aluminum are known as "crystalline aluminosilicates".

Zeolite may be used as a crystalline aluminosilicate. As preferred examples there may be mentioned Y-zeolite, ultra-stabilized Y-zeolite (USY zeolite), β-zeolite, mordenite and ZSM-5, among which USY zeolite is particularly preferred. According to the invention, one type of crystalline aluminosilicate may be used alone, or two or more may be used in combination.

The method of preparing the carrier containing the crystalline aluminosilicate may be a method in which a mixture of the crystalline aluminosilicate and binder is shaped and the shaped body is calcinated. There are no particular restrictions on the binder used, but alumina, silica, silica-alumina, titania and magnesia are preferred, and alumina is particularly preferred. There are also no particular restrictions on the proportion of binder used, but normally it will be preferably 5-99% by mass and more preferably 20-99% by mass based on the total mass of the shaped body. The calcinated temperature for the shaped body comprising the crystalline aluminosilicate and binder is preferably 430-470° C., more preferably 440-460° C. and even more preferably 445-455° C. The calcinating time is not particularly restricted but will normally be 1 minute-24 hours, preferably 10 minutes to 20 hours and more preferably 30 minutes-10 hours. The calcinating may be carried out in an air atmosphere, but is preferably carried out in an oxygen-free atmosphere such as a nitrogen atmosphere.

The Group VIb metal supported on the carrier may be chromium, molybdenum, tungsten or the like, and the Group VIII metal may be, specifically, cobalt, nickel, rhodium, palladium, iridium, platinum or the like. These metals may be used as single metals alone, or two or more thereof may be used in combination. For a combination of two or more metals, two precious metals such as platinum and palladium may be combined, two base metals such as nickel, cobalt, tungsten and molybdenum may be combined, or a precious metal and a base metal may be combined.

The metal may be loaded onto the carrier by impregnation of the carrier with a solution containing the metal, or by a usual method such as ion exchange. The loading amount of the metal may be selected as appropriate, but it will usually be 0.05-2% by mass and preferably 0.1-1% by mass based on the total mass of the catalyst.

(Hydrocracking/Hydroisomerization Step)

Production process B includes hydrocracking/hydroisomerization of a stock oil containing paraffinic hydrocarbons, in the presence of the aforementioned catalyst. The hydrocracking/hydroisomerization step may be carried out using a fixed bed reactor. The conditions for the hydrocracking/hydroisomerization are preferably, for example, a temperature of 250-400° C., a hydrogen pressure of 0.5-10 MPa and a stock oil liquid space velocity (LHSV) of 0.5-10 $h^{-1}$.

(Distilling Separation Step)

The lube-oil distillate is then subjected to distilling separation from the cracked product oil obtained from the hydrocracking/hydroisomerization step described above. The distilling separation step in production process B is the same as the distilling separation step in production process A and will not be explained again here.

(Dewaxing Step)

The lube-oil distillate obtained by fractional distillation from the cracked product oil in the distilling separation step described above is then subjected to dewaxing. The dewaxing step may be carried out by a conventionally known dewaxing process such as solvent dewaxing or catalytic dewaxing. When the substances with a boiling point of 370° C. and below in the cracking/isomerization product oil have not been separated from the high boiling point substances before dewaxing, the entire hydroisomerization product may be dewaxed, or the fraction with a boiling point of above 370° C. may be dewaxed, depending on the intended purpose of the cracking/isomerization product oil.

For solvent dewaxing, the hydroisomerization product is contacted with cool ketone and acetone and another solvent such as MEK or MIBK, and then cooled for precipitation of the high pour point substances as solid wax, and the precipitate separated from the solvent-containing lube-oil distillate (raffinate). The raffinate is then cooled with a scraped surface chiller for removal of the solid wax. Low molecular hydrocarbons such as propane can also be used for the dewaxing, in which case the cracking/isomerization product oil and low molecular hydrocarbons are mixed and at least a portion thereof is gasified to further cool the cracking/isomerization product oil and precipitate the wax. The wax is separated from the raffinate by filtration, membrane separation or centrifugal separation. The solvent is then removed from the raffinate and the raffinate is subjected to fractional distillation to obtain the target lubricating base oil.

In the case of catalytic dewaxing (catalyst dewaxing), the cracking/isomerization product oil is reacted with hydrogen in the presence of a suitable dewaxing catalyst under conditions effective for lowering the pour point. For catalytic dewaxing, some of the high-boiling-point substances in the cracking/isomerization product are converted to low-boiling-point substances, and then the low-boiling-point substances are separated from the heavy base oil fraction and the base oil fraction is subjected to fractional distillation to obtain two or more lubricating base oils. The low-boiling-point substances may be separated either before obtaining the target lubricating base oil or during the fractional distillation.

The dewaxing catalyst is not particularly restricted so long as the solid point of the dewaxing oil from the SAE10 class fraction is −25° C. or below, it is preferably one that yields the target lubricating base oil at high yield from the cracking/isomerization product oil. As such dewaxing catalysts there are preferred shape-selective molecular sieves, and specifically there may be mentioned ferrierite, mordenite, ZSM-5, ZSM-11, ZSM-23, ZSM-35, ZSM-22 (also known as Theta-1 or TON), silicoaluminophosphates (SAPO) and the like. These molecular sieves are preferably used in combination with catalyst metal components and more preferably in combination with precious metals. An example of a preferred combination is a complex of platinum and H-mordenite.

The dewaxing conditions are not particularly restricted, but the temperature is preferably 200-500° C. and the hydrogen pressure is preferably 10-200 bar (1 MPa-20 MPa). For a flow-through reactor, the $H_2$ treatment speed is preferably 0.1-10 kg/l/hr and the LHSV is preferably $0.1\text{-}10^{-1}$ and more preferably $0.2\text{-}2.0\ h^{-1}$. The dewaxing is preferably carried out in such a manner that substances with initial boiling points of 350-400° C., normally present at no greater than 40% by mass and preferably no greater than 30% by mass in the cracking/isomerization product oil, are converted to substances with boiling points of below their initial boiling points.

Production process A and production process B were explained above as preferred production processes for lubricating base oils of the invention, but the production process for a lubricating base oil of the invention is not limited thereto. For example, in production process A, a synthetic wax such as FT wax or GTL wax may be used instead of slack wax. Also, a stock oil comprising slack wax (preferably slack wax A or B) may be used in production process B. In addition, production processes A and B may employ both slack wax (preferably slack wax A or B) and synthetic wax (preferably FT wax or GTL wax).

When the stock oil used for production of the lubricating base oil of the invention is a blended oil comprising the aforementioned slack wax and/or synthetic wax and a stock oil in addition to these waxes, the content of the slack wax and/or synthetic wax is preferably at least 50% by mass based on the total mass of the stock oil.

The stock oil for production of the lubricating base oil of the invention is preferably a stock oil comprising slack wax and/or synthetic wax wherein the oil content is preferably no greater than 60% by mass, more preferably no greater than 50% by mass and even more preferably no greater than 25% by mass.

The lubricating base oil of the invention will now be explained in greater detail.

The saturated component content of the lubricating base oil of the invention is 90% by mass as mentioned above, preferably 95% by mass or greater, more preferably 97% by mass or greater and even more preferably 98% by mass or greater, based on the total mass of the lubricating base oil. The proportion of cyclic saturated components in the saturated components is 40% by mass as mentioned above, but it is preferably no greater than 30% by mass, more preferably no greater than 25% by mass, even more preferably no greater than 20% by mass, yet more preferably no greater than 10% by mass and most preferably no greater than 5% by mass. If the saturated component content and the proportion of cyclic saturated components in the saturated components satisfies the conditions specified above, and the viscosity index, aniline point and ϵ-methylene proportion also satisfy the specified conditions, it will be possible to achieve a satisfactory viscosity-temperature characteristic and heat and oxidation stability, and to achieve both a high viscosity index and an excellent low temperature viscosity property at below −35° C., even without using synthetic oils such as poly-α-olefins or esters or low-viscosity mineral oil base oils. Moreover, when additives have been added to the lubricating base oil, it can exhibit an even higher level of function for the additives while maintaining satisfactorily stable dissolution of the additives in the lubricating base oil. In addition, if the saturated component content and the proportion of cyclic saturated components among the saturated components satisfy these conditions, it will be possible to improve the frictional properties of the lubricating base oil itself, thereby achieving an improved effect of reducing friction and providing greater energy savings.

If the saturated component content is less than 90% by mass, the heat and oxidation stability, viscosity-temperature characteristic and frictional properties will be inadequate. If the proportion of cyclic saturated components among the saturated components exceeds 40% by mass, the efficacy of additives will be reduced when additives are included in the lubricating base oil.

A cyclic saturated component content of no greater than 40% by mass among the saturated components in the lubricating base oil of the invention is equivalent to an acyclic saturated component content of 60% by mass or greater among the saturated components. Acyclic saturated components include both straight-chain paraffins and branched paraffins. The proportion of each type of paraffin in the lubricating base oil of the invention is not particularly restricted, but the proportion of branched paraffins is preferably 54-99.9% by mass, more preferably 80-99.5% by mass, even more preferably 95-99% by mass and most preferably 97-99% by mass based on the total mass of the lubricating base oil. If the proportion of branched paraffins in the lubricating base oil satisfies this condition, the heat and oxidation stability and viscosity-temperature characteristic can be further improved, and when additives are added to the lubricating base oil, the functions of the additives can be exhibited at an even higher level while sufficiently maintaining stable dissolution of the additives.

The content of monocyclic saturated components and bicyclic or greater saturated components among the saturated components in the lubricating base oil of the invention is not particularly restricted so long as their total is no greater than 40% by mass, but the proportion of bicyclic or greater saturated components among the saturated components is preferably no greater than 20% by mass, more preferably no greater than 15% by mass and even more preferably no greater than 11% by mass. Also, the proportion of bicyclic or greater saturated components among the saturated components is preferably at least 0.5% by mass, more preferably at least 0.8% by mass and even more preferably at least 1% by mass. The proportion of monocyclic saturated components in the saturated components may be 0% by mass, but it is preferably 0.1% by mass or greater, and preferably no greater than 20% by mass, more preferably no greater than 10% by mass, even more preferably no greater than 5% by mass and most preferably no greater than 3% by mass.

The ratio ($M_A/M_B$) between the mass of monocyclic saturated components ($M_A$) and the mass of bicyclic or greater saturated components ($M_B$) of the cyclic saturated components in the lubricating base oil of the invention is preferably no greater than 20, more preferably no greater than 3, even more preferably no greater than 2, yet more preferably no greater than 1 and most preferably no greater than 0.5. $M_A/M_B$ may be zero, but it is preferably 0.01 or greater and more preferably 0.05 or greater. If $M_A/M_B$ satisfies this condition, it will be possible to achieve even higher levels for both the viscosity-temperature characteristic and heat and oxidation stability.

The saturated component content according to the invention is the value measured based on ASTM D 2007-93 (units: % by mass).

The proportions of cyclic saturated components, monocyclic saturated components, bicyclic or greater saturated components and acyclic saturated components among the saturated components, according to the invention, are the naphthene portion (monocyclic to hexacyclic naphthenes, units: % by mass) and alkane portion (units: % by mass), each measured based on ASTM D 2786-91.

The straight-chain paraffin content of the lubricating base oil according to the invention is that obtained by subjecting the saturated component portion that has been separated and fractionated by the method described in ASTM D 2007-93 mentioned above, to gas chromatography under the conditions described below, in order to identify and quantify the straight-chain paraffin content of the saturated component, and expressing the measured value with respect to the total mass of the lubricating base oil. For identification and quantitation, a C5-50 straight-chain paraffin mixture sample is used as the standard sample, and the straight-chain paraffin content among the saturated components is determined as the proportion of the total of the peak areas corresponding to each straight-chain paraffin, with respect to the total peak area of the chromatogram (subtracting the peak area for the diluent).

(Gas Chromatography Conditions)

Column: Liquid phase nonpolar column (length: 25 mm, inner diameter: 0.3 mmϕ, liquid phase film thickness: 0.1 μm)

Temperature elevating conditions: 50° C.-400° C. (temperature-elevating rate: 10° C./min)

Carrier gas: Helium (linear speed: 40 cm/min)

Split ratio: 90/1

Sample injection rate: 0.5 μL (injection rate of sample diluted 20-fold with carbon disulfide)

The proportion of branched paraffins in the lubricating base oil is the difference between the acyclic saturated component content among the saturated components and the straight-chain paraffin content among the saturated components, and it is a value expressed with respect to the total mass of the lubricating base oil.

Separation of the saturated components or composition analysis of the cyclic saturated components and acyclic saturated components may be accomplished using similar methods that give comparable results. For example, in addition to the methods described above, there may be mentioned the method of ASTM D 2425-93, the method of ASTM D 2549-91, high performance liquid chromatography (HPLC) methods and modified forms of these methods.

The aromatic content of the lubricating base oil of the invention is not particularly restricted so long as the saturated component content, the proportion of cyclic saturated components among the saturated components, the viscosity index, the aniline point and the ϵ-methylene proportion satisfy the aforementioned conditions, but it is preferably no greater than 5% by mass, more preferably no greater than 4% by mass and even more preferably no greater than 3% by mass, and also preferably 0.1% by mass or greater, more preferably 0.5% by mass or greater, even more preferably 1% by mass or greater and most preferably 1.5% by mass or greater, based on the total mass of the lubricating base oil. If the aromatic content exceeds the aforementioned upper limit, the viscosity-temperature characteristic, heat and oxidation stability and frictional properties, as well as the resistance to volatilization and low temperature viscosity characteristic, will tend to be reduced, and the efficacy of additives will be reduced when additives are included in the lubricating base oil. The lubricating base oil of the invention may be free of aromatic components, but an aromatic content above the aforementioned lower limit can further increase the solubility of additives.

The aromatic content for the invention is the value measured according to ASTM D 2007-93. The aromatic components normally include alkylbenzenes and alkylnaphthalenes, as well as anthracene, phenanthrene and their alkylated forms, and compounds with four or more condensed benzene rings, aromatic compounds with heteroatoms such as pyridines, quinolines, phenols and naphthols, and the like.

The viscosity index of the lubricating base oil of the invention is at least 110 as mentioned above, but it is preferably 120 or greater, more preferably 130 or greater, even more preferably 135 or greater and most preferably 138 or greater. If the viscosity index is less than 110, the viscosity-temperature characteristic may be insufficient, while the heat and oxidation stability and resistance to volatilization may be reduced.

The "viscosity index" for the invention is the viscosity index measured according to JIS K 2283-1993.

The aniline point (AP (° C.)) of the lubricating base oil of the invention is 106° C. or higher as mentioned above, but it is preferably 110° C. or higher, more preferably 115° C. or higher and even more preferably 118° C. or higher. If the aniline point is below the aforementioned lower limit, the viscosity-temperature characteristic, heat and oxidation stability, resistance to volatilization and low temperature viscosity property may be reduced, and the efficacy of additives may be lower when additives are included in the lubricating base oil. The aniline point for the invention is the aniline point measured according to JIS K 2256-1985.

The ϵ-methylene proportion of the total constituent carbons of the lubricating base oil of the invention is 14-20% as mentioned above, but it is preferably 14.5-19%, more preferably 15-18% and most preferably 15-17%. If the ϵ-methylene proportion is less than 14% the viscosity-temperature characteristic and heat and oxidation stability may be reduced, while if it exceeds 20% the low temperature viscosity property will tend to be lower, and significantly lower at above 25%. As a different aspect of the invention, an ϵ-methylene proportion of at least 20% and no greater than 25%, and preferably 20.5-24% will allow a viscosity index of between 140 and 160 and preferably 142-150 to be achieved, in order to obtain a lubricating base oil with a satisfactory low temperature viscosity property and sufficient heat and oxidation stability. This type of lubricating base oil can exhibit, for example, a −35° C. CCS viscosity of less than 3000 mPa·s, preferably 2200-2900 mPa·s and even more preferably 2300-2800 mPa·s, and a lubricating oil composition employing such a lubricating base oil can exhibit a −40° C. MRV viscosity of 60,000 mPa·s or lower and preferably 40,000 mPa·s or lower.

The ϵ-methylene proportion of the total constituent carbons of the lubricating base oil of the invention is the proportion of the total integrated intensity attributable to $CH_2$ chains with respect to the total carbon integrated intensity as measured by $^{13}$C-NMR, although another method may be used if it gives comparable results. According to the invention, $^{13}$C-NMR measurement is conducted using a sample diluted by addition of 3 g of heavy chloroform to 0.5 g of the sample, with a measuring temperature of room temperature and a resonance frequency of 100 MHz. The measuring method used was gated coupling.

This method of analysis yields results for:

(a) the total integrated intensity at a chemical shift of about 10-50 ppm (total integrated intensity attributable to total constituent carbons), and (b) the total integrated intensity at a chemical shift of 29.7-30.0 ppm (total integrated intensity attributable to ϵ-methylene), and the proportion of (b) (%) with respect to (a) as 100% is calculated from the results. The proportion of (b) represents the ϵ-methylene proportion with respect to the total constituent carbons in the lubricating base oil.

The ϵ-methylene proportion represents the proportion of carbon atoms with a prescribed chemical shift (ϵ) attributable to carbon atoms on the main chain other than the 4 carbon atoms (α-carbon, β-carbon, γ-carbon, δ-carbon) from the main chain molecular end and branched ends that have prescribed chemical shifts (α, β, γ, δ) in NMR. Assuming equivalent molecular weight (or average molecular weight) of the lubricating base oil, a large ϵ-methylene proportion corresponds to few branches, or to a long $CH_2$ chain length with no branches on the main chain, while a low ϵ-methylene proportion corresponds to many branches, or a short $CH_2$ chain length with no branches on the main chain.

The tertiary carbon proportion of the total constituent carbons in the lubricating base oil of the invention is not particularly restricted but is preferably 1-15%, more preferably 5-12% and even more preferably 6-10%. A tertiary carbon proportion within the aforementioned range will make it possible to obtain a lubricating base oil with an excellent viscosity-temperature characteristic and high heat and oxidation stability. According to the invention, if the tertiary carbon proportion of the total constituent carbons in the lubricating base oil is 5-8% and preferably 6-7%, the obtained lubricating oil composition will have a higher viscosity index, a lower −35° C. CCS viscosity and a smaller NOACK evaporation, whereas if the tertiary carbon proportion is 8-10% and preferably 9-10%, it will have a lower −40° C. MRV viscosity and a superior effect of preventing acid number increase in the presence of NOx. The tertiary carbon proportion is the proportion of carbon atoms of >CH— groups among the total constituent carbons, i.e. the proportion of carbon atoms in branches or in naphthenes.

Although, as mentioned above, the tertiary carbon proportion is the total integrated intensity attributable to tertiary carbons with respect to the total integrated intensity for all carbons as measured by $^{13}$C-NMR, another method may be used if it gives similar results.

The aforementioned method of analysis yields results for:

(a) the total integrated intensity at a chemical shift of about 10-50 ppm (total integrated intensity attributable to total constituent carbons), and (c) the total integrated intensity at chemical shifts of 27.9-28.1 ppm, 28.4-28.6 ppm, 32.6-33.2 ppm, 34.4-34.6 ppm, 37.4-37.6 ppm, 38.8-39.1 ppm and 40.4-40.6 ppm (total integrated intensity attributable to tertiary carbons bonded to methyl, ethyl and other branching groups and naphthenic tertiary carbons), and the proportion of (c) (%) with respect to (a) as 100% is calculated from the results. The proportion of (c) represents the tertiary carbon proportion with respect to the total constituent carbons in the lubricating base oil.

The proportion of carbons in terminal methyl groups (—$CH_3$) among the total constituent carbons in the lubricating base oil of the invention is not particularly restricted but is preferably 10-20%, more preferably 12-18% and even more preferably 14-16%. A proportion of carbons in terminal methyl groups within the aforementioned range will make it possible to obtain a lubricating base oil with an excellent viscosity-temperature characteristic and heat and oxidation stability.

Although, as mentioned above, the proportion of carbons in terminal methyl groups is the proportion of total integrated intensity attributable to carbons in terminal methyl groups with respect to the total integrated intensity for all carbons as measured by $^{13}$C-NMR, another method may be used if it gives similar results.

This method of analysis yields results for:

(a) the total integrated intensity at a chemical shift of about 10-50 ppm (total integrated intensity attributable to total constituent carbons), and (d) the total integrated intensity at chemical shifts of 10.7-11.6 ppm, 13.8-14.7 ppm, 19.2-20.1 ppm and 22.5-22.8 ppm (total integrated intensity attributable to carbon atoms of terminal methyl groups (—$CH_3$)), and the proportion of (d) (%) with respect to (a) as 100% is calculated from the results. The proportion of (d) represents the proportion of terminal methyl groups with respect to the total constituent carbons in the lubricating base oil.

The other properties and components of the lubricating base oil of the invention are not particularly restricted so long as the saturated component content, the proportion of cyclic saturated components among the saturated components, the viscosity index, the aniline point and the ϵ-methylene proportion satisfy the aforementioned conditions, but the carbon distribution in the lubricating base oil of the invention is preferably a mean number of carbons of 20-35, more preferably 25-35 and even more preferably 28-30.

The % $C_P$ of the lubricating base oil of the invention is not particularly restricted but is preferably 80 or greater, more preferably 82-99, even more preferably 85-98 and yet more preferably 90-97. If the % $C_P$ of the lubricating base oil is less than 80, the viscosity-temperature characteristic, heat and oxidation stability and frictional properties will tend to be reduced, and the efficacy of additives will tend to be reduced when additives are included in the lubricating base oil. If the % $C_P$ of the lubricating base oil exceeds 99, the solubility of additives will tend to be lower.

The % $C_N$ of the lubricating base oil of the invention is not particularly restricted but is preferably no greater than 12, more preferably 1-12 and even more preferably 3-10. If the % $C_N$ of the lubricating base oil is greater than 12, the viscosity-temperature characteristic, heat and oxidation stability and frictional properties will tend to be reduced. If % $C_N$ is less than 1, the solubility of additives will tend to be lower.

The % $C_A$ of the lubricating base oil of the invention is not particularly restricted but is preferably no greater than 0.7, more preferably no greater than 0.6 and even more preferably no greater than 0.1-0.5. If the % $C_A$ of the lubricating base oil is greater than 0.7, the viscosity-temperature characteristic, heat and oxidation stability and frictional properties will tend to be reduced. The % $C_A$ of the lubricating base oil of the invention may be zero, but a % $C_A$ of 0.1 or greater can further increase the solubility of additives.

There are no particular restrictions on the ratio of % $C_P$ and % $C_N$ in the lubricating base oil of the invention, but % $C_P$/% $C_N$ is preferably at least 7, more preferably at least 7.5 and even more preferably at least 8. If the % $C_P$/% $C_N$ is less than 7, the viscosity-temperature characteristic, heat and oxidation stability and frictional properties will tend to be reduced, and the efficacy of additives will tend to be reduced when additives are included in the lubricating base oil. Also, % $C_P$/% $C_N$ is preferably no greater than 200, more preferably no greater than 100, even more preferably no greater than 50 and most preferably no greater than 25. A % $C_P$/% $C_N$ ratio of 200 or smaller can further increase the solubility of additives.

The values of % $C_P$, % $C_N$ and % $C_A$ according to the invention are, respectively, the percentage of the number of paraffin carbon atoms with respect to the total number of carbon atoms, the percentage of naphthene carbon atoms with respect to the total number of carbon atoms and the percentage of aromatic carbon atoms with respect to the total number of carbon atoms, as determined by the method of ASTM D 3238-85 (n-d-M ring analysis). That is, the preferred ranges for % $C_P$, % $C_N$ and % $C_A$ are based on values determined by this method, and for example, % $C_N$ determined by the method may be a value exceeding zero even when the lubricating base oil contains no naphthene components.

The sulfur content of the lubricating base oil of the invention depends on the sulfur content of the stock oil. For example, when using a stock oil containing essentially no sulfur, such as a synthetic wax component obtained by Fischer-Tropsch reaction, it is possible to obtain a lubricating base oil containing essentially no sulfur. Or, when using a stock oil that contains sulfur, such as slack wax obtained by a lubricating base oil refining process or a microwax obtained by a wax refining process, the sulfur content of the obtained lubricating base oil will usually be 100 ppm by mass or greater. From the viewpoint of further improving the heat and oxidation stability and lowering the sulfur content, the sulfur content of the lubricating base oil of the invention is preferably no greater than 100 ppm by mass, more preferably no greater than 50 ppm by mass, even more preferably no greater than 10 ppm by mass and most preferably no greater than 5 ppm by mass.

From the viewpoint of cost reduction, the stock oil used is preferably slack wax, in which case the sulfur content of the obtained lubricating base oil is preferably no greater than 50 ppm by mass and more preferably no greater than 10 ppm by mass. The sulfur content of the invention is the sulfur content measured according to JIS K 2541-1996.

The nitrogen content of the lubricating base oil of the invention is not particularly restricted, but it is preferably no greater than 5 ppm by mass, more preferably no greater than 3 ppm by mass and even more preferably no greater than 1 ppm by mass. If the nitrogen content is greater than 5 ppm by mass, the heat and oxidation stability will tend to be reduced. The nitrogen content of the invention is the nitrogen content measured according to JIS K 2609-1990.

There are no particular restrictions on the 100° C. kinematic viscosity of the lubricating base oil of the invention, but it is generally 1-10 $mm^2/s$, preferably 3.5-6 $mm^2/s$, more preferably 3.7-4.5 $mm^2/s$ and even more preferably 3.9-4.2 $mm^2/s$. If the 100° C. kinematic viscosity of the lubricating base oil is less than 3.5 $mm^2/s$ the evaporation loss will tend to be increased, while if it is greater than 6 $mm^2/s$ the low temperature viscosity property at −40° C. will tend to be significantly impaired.

There are also no particular restrictions on the 40° C. kinematic viscosity of the lubricating base oil of the invention, but it is generally 5-100 $mm^2/s$, preferably 12-32 $mm^2/s$, more preferably 13-19 $mm^2/s$ and even more preferably 15-17.5 $mm^2/s$. If the 40° C. kinematic viscosity of the lubricating base oil is less than 12 $mm^2/s$ the evaporation loss will tend to be increased, while if it is greater than 32 $mm^2/s$ the low temperature viscosity property at −40° C. will tend to be impaired.

There are, in addition, no particular restrictions on the solid point of the lubricating base oil of the invention, but it is preferably no higher than −20° C., more preferably no higher than −25° C. and even more preferably no higher than −28° C. Under temperature conditions of about −30° C. it is possible to achieve sufficient low-temperature characteristics even when the solid point of the lubricating base oil exceeds −25° C., but in order to obtain a lubricating oil with excellent low temperature viscosity properties (CCS viscosity, MRV viscosity, BF viscosity) at below −35° C. and especially a lubricating oil with significant improvement in the MRV viscosity at −40° C., it is important for the solid point to be no higher than −20° C. and especially no higher than −25° C. Also, although the low temperature performance can be improved by lowering the solid point of the lubricating base oil, from the viewpoint of a lower viscosity index and of economy, the solid point is preferably −45° C. or higher, more preferably −40° C. or higher and even more preferably −35° C. or higher. According to the invention, the solid point of the lubricating base oil is most preferably −35 to −25° C. to obtain a lubricating base oil with a high level of both high viscosity index and low-temperature characteristics, as well as excellent economy. A lubricating base oil with a solid point of no higher than −20° C. can be obtained by dewaxing treatment such as the aforementioned solvent dewaxing process or catalytic dewaxing process, but any dewaxing treatment method may be employed so long as it can yield a dewaxed lubricating base oil with a solid point of no higher than −20° C.

The solid point according to the invention is a temperature 1° C. below the minimum temperature at which flow of the sample is observed, as measured with the pour point measuring interval (2.5° C.) according to JIS K 2269-1987 (JIS pour point) set to 1° C. The JIS pour point gives results for an interval of 2.5° C., but from the viewpoint of measuring error and reproducibility, this method is not suitable for the invention which requires strict control of the critical point for the low-temperature characteristic.

The −35° C. CCS viscosity of the lubricating base oil of the invention is preferably no greater than 2800 mPa·s, more preferably no greater than 2200 mPa·s and even more preferably no greater than 2000 mPa·s. The −35° C. CCS viscosity for the invention is the viscosity measured according to JIS K2010-1993.

A lubricating base oil of the invention may be used in a lubricating oil composition of the invention to obtain a −40° C. MRV viscosity of preferably no greater than 30,000 mPa·s, more preferably no greater than 20,000 mPa·s, even more preferably no greater than 15,000 mPa·s, yet more preferably no greater than 13,000 mPa·s, even yet more preferably no greater than 12,000 mPa·s, especially preferably no greater than 10,000 mPa·s and most preferably no greater than 8000 mPa·s, and also with a yield stress of 0 Pa (no yield stress). The −40° C. MRV viscosity and yield stress for the invention are the viscosity and yield stress as measured according to ASTM D 4684.

A lubricating base oil of the invention may be used in a lubricating oil composition of the invention to obtain a −40° C. BF viscosity of preferably no greater than 20,000 mPa·s, more preferably no greater than 15,000 mPa·s, even more preferably no greater than 10,000 mPa·s and most preferably no greater than 8000 mPa·s. The −40° C. BF viscosity for the invention is the viscosity as measured according to JPI-5S-26-99.

The lubricating base oil of the invention preferably satisfies the conditions represented by the following inequality (1).

$$1.435 \leqq n_{20} - 0.002 \times kv100 \leqq 1.453 \quad (1)$$

[wherein $n_{20}$ represents the refractive index of the lubricating base oil at 20° C., and kv100 represents the kinematic viscosity ($mm^2/s$) of the lubricating base oil at 100° C.]

Also, $n_{20}-0.002\times kv100$ for the lubricating base oil of the invention is preferably 1.435-1.450, more preferably 1.440-1.449, even more preferably 1.442-1.448 and most preferably 1.444-1.447. For production of a lubricating base oil having such properties, the stock oil introduced into the hydrocracking and/or hydroisomerization step is preferably one composed mainly of the aforementioned synthetic wax and/or slack wax, and more preferably a starting material composed mainly of the aforementioned synthetic wax and/or slack wax A. In this case, the proportion of branched paraffins in the lubricating base oil is preferably 80-99% by mass, but if the lubricating base oil is obtained using the aforementioned synthetic wax as the stock oil, the proportion of branched paraffins in the lubricating base oil is more preferably 95-99% by mass and even more preferably 97-99% by mass, while if the lubricating base oil is obtained using the aforementioned slack wax A as the stock oil, the proportion of branched paraffins is more preferably 82-98% by mass and even more preferably 90-95% by mass.

When the lubricating base oil of the invention is a lubricating base oil with a saturated component content of 90% by mass or greater and a proportion of cyclic saturated components of 5-40% by mass and preferably 10-25% by mass among the saturated components, $n_{20}-0.002\times kv100$ may be 1.435-1.453, preferably 1.440-1.452, more preferably 1.442-1.451 and even more preferably 1.444-1.450. For production of a lubricating base oil having such properties, the starting material introduced into the hydrocracking and/or hydroisomerization step is preferably one composed mainly of the aforementioned synthetic wax and/or slack wax, and more preferably a starting material composed mainly of slack wax B. In this case, the proportion of branched paraffins in the lubricating base oil is more preferably 54-99% by mass, even more preferably 58-95% by mass, yet more preferably 70-92% by mass and most preferably 80-90% by mass.

If $n_{20}-0.002\times kv100$ is within the aforementioned range, it is possible to achieve even higher levels for both the viscosity-temperature characteristic and heat and oxidation stability, and when additives are included in the lubricating base oil, it can exhibit an even higher level of function for the additives while maintaining satisfactorily stable dissolution of the additives in the lubricating base oil. Limiting $n_{20}-0.002\times kv100$ to the aforementioned range can also improve the frictional properties of the lubricating base oil itself, resulting in an enhanced friction reducing effect and thus increased energy savings.

If $n_{20}-0.002\times kv100$ exceeds the aforementioned upper limit, the viscosity-temperature characteristic, heat and oxidation stability and frictional properties will tend to be insufficient, and the efficacy of additives will tend to be reduced when additives are included in the lubricating base oil. If $n_{20}-0.002\times kv100$ is below the aforementioned lower limit, the solubility of additives will be insufficient when additives are included in the lubricating base oil, and the effective amount of additives kept dissolved in the lubricating base oil will be reduced, thus tending to prevent the additives from effectively exhibiting their functions.

In order to satisfy the above inequality, the 20° C. refractive index of the lubricating base oil of the invention is preferably 1.450-1.465, more preferably 1.452-1.463 and even more preferably 1.453-1.462. The 20° C. refractive index ($n_{20}$) for the invention is the refractive index measured at 20° C. according to ASTM D1218-92. The 100° C. kinematic viscosity (kv100) for the invention is the kinematic viscosity measured at 100° C. according to JIS K 2283-1993.

The pour point of the lubricating base oil composition of the invention is preferably no higher than −20° C., more preferably no higher than −22.5° C., even more preferably no higher than −25° C., yet more preferably no higher than −27.5° C. and most preferably no higher than −30° C. If the pour point is above the aforementioned upper limit, the low temperature viscosity property of the lubricating base oil and lubricating oil composition at below −35° C. will tend to be impaired. The pour point for the invention is the pour point measured according to JIS K 2269-1987.

The 15° C. density ($\rho_{15}$, units: $g/cm^3$) of the lubricating base oil of the invention is preferably no greater than 0.835 $g/cm^3$, more preferably no greater than 0.830 $g/cm^3$ and even more preferably no greater than 0.825 $g/cm^3$, and also preferably at least 0.810 $g/cm^3$. The 15° C. density for the invention is the density measured at 15° C. according to JIS K 2249-1995.

The NOACK evaporation of the lubricating base oil of the invention is not particularly restricted, but it is preferably no greater than 20% by mass, more preferably no greater than 16% by mass, even more preferably no greater than 15% by mass, yet more preferably no greater than 14% by mass and most preferably no greater than 12% by mass, and also preferably 6% by mass or greater, more preferably 8% by mass or greater and even more preferably 10% by mass or greater. If the NOACK evaporation is below the aforementioned lower limit, it will tend to be difficult to achieve improvement in the low temperature viscosity property. The NOACK evaporation is preferably not above the aforementioned upper limit because evaporation loss of the lubricating oil will become considerable and catalyst poisoning will be accelerated, when the lubricating base oil is used as an internal combustion engine lubricating oil. The NOACK evaporation for the invention is the evaporation loss measured according to ASTM D 5800-95.

The iodine number of the lubricating base oil of the invention is preferably no greater than 2.5, more preferably no greater than 1.5, even more preferably no greater than 1 and most preferably no greater than 0.8, and while it may be less than 0.01, it is preferably 0.01 or greater, more preferably 0.1 or greater and even more preferably 0.5 or greater from the standpoint of economy and of exhibiting a substantial effect. The heat and oxidation stability can be drastically improved if the iodine number of the lubricating base oil is 2.5 or smaller. The "iodine number" for the invention is the iodine number measured according to the indicator titration method described in JIS K 0070, "Chemical Product Acid Number, Saponification Value, Iodine Number, Hydroxyl Value and Unsaponification Value".

The distillation property of the lubricating base oil of the invention is based on gas chromatography distillation, and the initial boiling point (IBP) is preferably 300-380° C., more preferably 320-370° C. and even more preferably 330-360° C. The 10% distillation temperature (T10) is preferably 340-420° C., more preferably 350-410° C. and even more preferably 360-400° C. The 50% distillation temperature (T50) is preferably 380-460° C., more preferably 390-450° C. and even more preferably 400-460° C. The 90% distillation temperature (T90) is preferably 440-500° C., more preferably 450-490° C. and even more preferably 460-480° C. The end point (FBP) is preferably 460-540° C., more preferably 470-530° C. and even more preferably 480-520° C. T90-T10 is preferably 50-100° C., more preferably 60-95° C. and even more preferably 80-90° C. FBP-IBP is preferably 100-250° C., more preferably 120-180° C. and even more preferably 130-160° C. T10-IBP is preferably 10-70° C., more preferably 15-60° C. and even more preferably 20-50° C. FBP-T90 is preferably 10-50° C., more preferably 20-40° C. and even more preferably 25-35° C. If IBP, T10, T50, T90, FBP, T90-T10, FBP-IBP, T10-IBP and FBP-T90 are established within the aforementioned preferred ranges it will be possible to achieve further improvement in the low temperature viscosity and further reduction in evaporation loss. If each distillation ranges of T90-T10, FBP-IBP, T10-IBP and FBP-T90 that are too narrow, the lubricating base oil yield will be lower, therefore it will be uneconomical. For the purpose of the invention, IBP, T10, T50, T90 and FBP are the distillated temperature measured according to ASTM D 2887-97.

The residual metal content of the lubricating base oil of the invention is based on the catalyst and the metals in the starting materials that are unavoidable contaminants in the production process, and it is preferred for such residual metals to be thoroughly removed. For example, the Al, Mo and Ni contents are preferably each 1 ppm by mass or less. If the contents of these metals exceed the aforementioned upper limit, the functions of additives included in the lubricating base oil will tend to be inhibited.

The residual metal content for the invention is the metal content as measured according to JPI-5S-38-2003.

The lubricating base oil of the invention can exhibit excellent heat and oxidation stability if the saturated component content, the proportion of cyclic saturated components among the saturated components, the viscosity index, the aniline point and the ϵ-methylene proportion satisfy the aforementioned conditions, but in addition the RBOT life is preferably 350 min or greater, more preferably 370 min or greater and even more preferably 380 min or greater. If the RBOT life is shorter than this range, the viscosity-temperature characteristic and heat and oxidation stability of the lubricating base oil will tend to be reduced, and the efficacy of additives will tend to be reduced when additives are included in the lubricating base oil.

The RBOT life for the invention is the RBOT value as measured according to JIS K 2514-1996, for a composition obtained by adding a phenolic antioxidant (2,6-di-tert-butyl-p-cresol; DBPC) at 0.2% by mass to the lubricating base oil.

The lubricating base oil of the invention may be used alone as a lubricating oil, but alternatively the lubricating base oil of the invention may be used as a lubricating oil composition, in combination with one or more other base oils and/or additives.

When the lubricating oil composition of the invention comprises a lubricating base oil of the invention and another base oil, the proportion of the lubricating base oil of the invention in the blended base oil is preferably at least 30% by mass, more preferably at least 50% by mass and even more preferably at least 70% by mass.

There are no particular restrictions on other base oils to be used in combination with the lubricating base oil of the invention, and as examples of mineral oil base oils there may be mentioned solvent refined mineral oils, hydrocracked mineral oils, hydrorefined mineral oils and solvent dewaxed base oils with 100° C. dynamic viscosities of 1-100 $mm^2/s$.

As synthetic base oils there may be mentioned poly α-olefins and their hydrogenated products, isobutene oligomers and their hydrogenated products, isoparaffins, alkylbenzenes, alkylnaphthalenes, diesters (ditridecyl glutarate, di-2-ethylhexyl adipate, diisodecyl adipate, ditridecyl adipate, di-2-ethylhexyl sebacate and the like), polyol esters (trimethylolpropane caprylate, trimethylolpropane pelargonate, pentaerythritol 2-ethyl hexanoate, pentaerythritol pelargonate and the like), polyoxyalkylene glycols, dialkyldiphenyl ethers, polyphenyl ethers, and the like, among which poly α-olefins are preferred. As typical poly α-olefins there may be mentioned C2-32 and preferably C6-16 α-olefin oligomers or co-oligomers (1-octene oligomers, decene oligomers, ethylene-propylene co-oligomers and the like), and their hydrogenated products.

There are no particular restrictions on the method of preparing the poly α-olefins, and for example, there may be mentioned a method of polymerizing an α-olefin in the presence of a polymerization catalyst such as a Friedel-Crafts catalyst comprising a complex of aluminum trichloride or boron trifluoride with water, an alcohol (ethanol, propanol, butanol or the like), a carboxylic acid or an ester.

The lubricating oil composition of the invention may further contain additives. As additives to be included in the lubricating oil composition of the invention there may be used any additives conventionally employed in the field of lubricating oils, without any particular restrictions. As such lubricating oil additives there may be mentioned, specifically, antioxidants, ashless dispersants, metallic detergents, extreme-pressure agents, anti-wear agents, viscosity index improvers, pour point depressants, friction modifiers, oiliness agents, corrosion inhibitors, rust inhibitors, demulsifiers, metal deactivating agents, seal swelling agents, antifoaming agents, coloring agents and the like. These additives may be used alone or in combinations of two or more.

The lubricating oil composition of the invention preferably contains a pour point depressant and/or viscosity index improver among the aforementioned additives, from the viewpoint of notably improving the −40° C. BF viscosity or MRV viscosity. The pour point of a lubricating oil composition containing a pour point depressant and/or viscosity index improver is preferably −60 to −35° C. and more preferably −50 to −40° C.

The lubricating oil composition of the invention preferably also contains a viscosity index improver from the viewpoint of achieving further improvement in the viscosity-temperature characteristic As specific examples of viscosity index improvers there may be mentioned non-dispersed or dispersed polymethacrylates, dispersed ethylene-α-olefin copolymers or their hydrogenated products, polybutylene or its hydrogenated products, styrene-diene hydrogenation copolymer, styrene-maleic anhydride copolymer and polyalkylstyrenes, among which there are preferred non-dispersed viscosity index improvers and/or dispersed viscosity index improvers with weight-average molecular weights of 10,000-1,000,000, preferably 100,000-900,000, more preferably 150,000-500,000 and even more preferably 180,000-400,000. There are no particular restrictions on the PSSI (Permanent Shear Stability Index) of the viscosity index improver, but it is preferably 1-100 and more preferably 10-90, while for increased fuel efficiency it is even more preferably 50 or greater and most preferably 55 or greater. In order to achieve high levels of both shear stability and fuel efficiency, it is preferably 25-50 and even more preferably 30-45. The PSSI referred to here is the Permanent Shear Stability Index of the polymer as calculated based on ASTM D 6278-02 (Test Method for Shear Stability of Polymer Containing Fluid Using a European Diesel Injector Apparatus), according to ASTM D 6022-01 (Standard Practice for Calculation of Permanent Shear Stability Index).

Polymethacrylate-based viscosity index improvers are preferred among the viscosity index improvers mentioned above from the standpoint of achieving a more excellent low-temperature flow property, and dispersed polymethacrylate-based viscosity index improvers are especially preferred from the standpoint of dispersibility of oxidative degradation products.

The viscosity index improver content in the lubricating oil composition of the invention is preferably 0.1-15% by mass and more preferably 0.5-5% by mass based on the total mass of the composition. If the viscosity index improver content is less than 0.1% by mass, the improving effect on the viscosity-temperature characteristic by the addition will tend to be insufficient, while if it is greater than 15% by mass the heat and oxidation stability will tend to be reduced.

There are also no particular restrictions on the 100° C. kinematic viscosity of the lubricating oil composition of the invention, but it is preferably 4.5-21.9 $mm^2/s$, more preferably 5-16.3 $mm^2/s$, even more preferably 5.5-12.5 $mm^2/s$ and most preferably 5.5-9.3 $mm^2/s$. The viscosity index is also not particularly restricted but is preferably 160 or greater, more preferably 180 or greater, even more preferably 200 or greater, yet more preferably 210 or greater and most preferably 220 or greater. By increasing the viscosity index of the lubricating oil composition, it is possible to obtain a lubricating oil composition with an excellent viscosity index from low temperatures of below −35° C. to high temperatures, and to obtain a lubricating oil, and especially an engine oil or a drive transmission device lubricating oil, with even higher energy savings (fuel efficiency). According to the invention, it is possible to obtain a 0W-10 or 0W-20 fuel efficient engine oil with a 100° C. kinematic viscosity of 5-9 $mm^2/s$, or a fuel efficient drive transmission device lubricating oil with a 100° C. kinematic viscosity of 5-6 $mm^2/s$.

The lubricating base oil and lubricating oil composition of the invention having the structure described above exhibit excellent viscosity-temperature characteristics and heat and oxidation stability, as well as improved frictional properties of the lubricating base oil itself, and can provide both an improved friction reducing effect and enhanced energy savings. The lubricating oil composition of the invention allows additives to exhibit a higher level of function (heat and oxidation stability improving effect due to antioxidants, friction reducing effect due to friction modifiers, wear resistance improvement effect due to anti-wear agent, etc.) when additives are included in the lubricating base oil of the invention. The lubricating base oil and lubricating oil composition of the invention are therefore suitable for use in a variety of lubricating oil fields. As specific uses for the lubricating base oil and lubricating oil composition of the invention, there may be mentioned lubricating oils (internal combustion engine lubricating oils) used in internal combustion engines such as passenger vehicle gasoline engines, two-wheeler gasoline engines, diesel engines, gas engines, gas heat pump engines, marine engines, electric power engines and the like, lubricating oils (drive transmission device oils) used in drive transmission devices such as automatic transmissions, manual transmissions, continuously variable transmissions, final reduction gears and the like, hydraulic oils used in hydraulic power units such as dampers, construction equipment and the like, as well as compressor oils, turbine oils, industrial gear oils, refrigerator oils, rust preventing oils, heating medium oils, gas holder seal oils, bearing oils, paper machine oils, machine tool oils, sliding guide surface oils, electrical insulation oils, cutting oils, press oils, rolling oils, heat treatment oils and the like, and using a lubricating base oil or lubricating oil composition of the invention for such uses can improve the properties of lubricating oils including the viscosity-temperature characteristic, heat and oxidation stability, energy savings and fuel efficiency, while lengthening the lubricating oil life and achieving a higher level of reduction in the environmentally detrimental substances.

EXAMPLES

The present invention will now be explained in greater detail based on examples and comparative examples, with the understanding that these examples are in no way limitative on the invention.

Example 1

After mixing and kneading 800 g of USY zeolite and 200 g of an alumina binder, the mixture was shaped into a cylinder with a diameter of 1/16 inch (approximately 1.6 mm) and a height of 6 mm. The shaped body was calcinated at 450° C. for 3 hours to obtain a carrier. The carrier was impregnated with an aqueous solution containing dichlorotetraamineplatinum (II) in an amount of 0.8% by mass of the carrier in terms of platinum, and then dried at 120° C. for 3 hours and calcinated at 400° C. for 1 hour to obtain the catalyst.

Next, 200 ml of the obtained catalyst was packed into a fixed-bed circulating reactor, and the reactor was used for hydrocracking/hydroisomerization of the paraffinic hydrocarbon-containing stock oil. The stock oil used in this step was FT wax with a paraffin content of 95% by mass and a carbon number distribution from 20 to 80 (hereinafter referred to as "WAX1"). The properties of WAX1 are shown in Table 1. The conditions for the hydrocracking were a hydrogen pressure of 3 MPa, a reaction temperature of 350° C. and an LHSV of 2.0 $h^{-1}$, and a cracking/isomerization product oil was obtained comprising 30% by mass of the fraction with a boiling point of 380° C. and below (cracked product) with respect to the stock oil (30% cracking severity).

TABLE 1

| | |
|---|---|
| Name of starting wax | WAX1 |
| Kinematic viscosity at 100° C. ($mm^2/s$) | 5.8 |
| Melting point (° C.) | 70 |
| Oil content (% by mass) | <1 |
| Sulfur content (ppm by mass) | <0.2 |

The cracked product obtained by the hydrocracking was subjected to vacuum distillation to obtain a lube-oil distillate with a 100° C. kinematic viscosity of 4 $mm^2/s$. The lube-oil distillate was prepared with a methyl ethyl ketone-toluene mixed solvent to a solvent/oil ratio of 4, and subjected to solvent dewaxing until the solid point of the obtained solvent-dewaxed oil fell below −25° C., to obtain a lubricating base oil for Example 1 (hereinafter referred to as "base oil 1"). The dewaxing temperature was −25° C.

Example 2

The fraction separated by vacuum distillation in the step of refining a solvent refined base oil was subjected to solvent extraction with furfural and then to hydrotreatment, after which solvent dewaxing was performed with a methyl ethyl ketone-toluene mixed solvent. The slack wax removed during the solvent dewaxing was deoiled to obtain a wax portion (hereinafter referred to as "WAX2") for use as a lubricating base oil starting material. The properties of WAX2 are shown in Table 2.

TABLE 2

| | |
|---|---|
| Name of starting wax | WAX2 |
| Kinematic viscosity at 100° C. ($mm^2/s$) | 6.8 |
| Melting point (° C.) | 58 |
| Oil content (% by mass) | 6.3 |
| Sulfur content (ppm by mass) | 900 |

WAX2 was hydrocracked in the presence of a hydrocracking catalyst under conditions with a hydrogen partial pressure of 5 MPa, a mean reaction temperature of 350° C. and an LHSV of 1 $hr^{-1}$. The hydrocracking catalyst used was a sulfurized catalyst comprising 3% by mass nickel and 15% by mass molybdenum supported on an amorphous silica-alumina carrier (silica:alumina=20:80 (mass ratio)).

The cracked product obtained by the hydrocracking was subjected to vacuum distillation to obtain a lube-oil distillate with a 100° C. kinematic viscosity of 4 $mm^2/s$. The lube-oil distillate was prepared with a methyl ethyl ketone-toluene mixed solvent to a solvent/oil ratio of 4, and subjected to solvent dewaxing until the solid point of the obtained solvent-dewaxed oil fell below −25° C., to obtain a lubricating base oil for Example 2 (hereinafter referred to as "base oil 2"). The dewaxing temperature was −32° C.

The properties and performance evaluation test results for the lubricating base oils of Examples 1 and 2 are shown in Table 3. Also, Table 4 shows the properties and performance evaluation test results for base oils 3-6, as conventional high viscosity index base oils for Comparative Examples 1-4.

TABLE 3

| | | | Example 1 | Example 2 |
|---|---|---|---|---|
| Base oil name | | | Base oil 1 | Base oil 2 |
| Name of starting wax | | | WAX1 | WAX2 |
| Components of base oil (based on total base oil) | Saturated | % by mass | 99.5 | 98.6 |
| | Aromatic | % by mass | 0.4 | 1.3 |
| | Polar compounds | % by mass | 0.1 | 0.1 |
| Saturated compound contents (based on total saturated content) | Cyclic saturated | % by mass | 1.3 | 5.0 |
| | Acyclic saturated | % by mass | 98.7 | 95.0 |
| EI-MS saturated compound analysis - Cyclic saturated compound contents (based on total saturated content) | Monocylic saturated | % by mass | 0.1 | 1.3 |
| | Bicyclic or greater saturated | % by mass | 1.2 | 3.7 |
| | Monocylic/bicyclic or greater saturated (mass ratio) | | 0.08 | 0.35 |
| Sulfur content | | ppm by mass | <1 | <1 |
| Nitrogen content | | ppm by mass | <3 | <3 |
| Kinematic viscosity (40° C.) | | $mm^2/s$ | 16.7 | 16.3 |
| Kinematic viscosity (100° C.) kv100 | | $mm^2/s$ | 3.9 | 3.9 |
| Viscosity index | | | 131 | 140 |
| Solid point | | ° C. | −28 | −29 |
| $^{13}C$-NMR | CH | % | 9.3 | 6.7 |
| | $CH_3$ | % | 15.6 | 15.8 |
| | ϵ-Methylene proportion | % | 15.8 | 19.6 |
| Iodine value | | | 0.2 | 0.6 |
| Aniline point | | ° C. | 120.5 | 119 |
| CCS viscosity (−35° C.) | | mPa · s | 1970 | 1820 |
| NOACK evaporation (250° C., 1 hour) | | % by mass | 14.9 | 10.7 |

TABLE 4

| | | | Comp. Ex. 1 | Comp. Ex. 2 | Comp. Ex. 3 | Comp. Ex. 4 |
|---|---|---|---|---|---|---|
| Base oil name | | | Base oil 3 | Base oil 4 | Base oil 5 | Base oil 6 |
| Name of starting wax | | | WAX2 | WAX2 | — | — |
| Components of base oil (based on total base oil) | Saturated | % by mass | 98.5 | 98.4 | 99.7 | 94.7 |
| | Aromatic | % by mass | 1.3 | 1.4 | 0.3 | 5.3 |
| | Polar compounds | % by mass | 0.2 | 0.2 | 0.0 | 0.0 |
| Saturated compound contents (based on total saturated content) | Cyclic saturated | % by mass | 7.1 | 7.2 | 46.2 | 46.5 |
| | Acyclic saturated | % by mass | 92.9 | 92.8 | 53.8 | 53.5 |
| EI-MS saturated compound analysis - Cyclic saturated compound contents (based on total saturated content) | Monocyclic saturated | % by mass | 3.0 | 3.1 | — | 16.2 |
| | Bicyclic or greater saturated | % by mass | 4.1 | 4.1 | 26.1 | 30.3 |
| | Monocylic/bicyclic or greater saturated (mass ratio) | | 0.73 | 0.76 | 0.77 | 0.53 |
| Sulfur content | | ppm by mass | <1 | <1 | <1 | <1 |
| Nitrogen content | | ppm by mass | <3 | <3 | <3 | <3 |
| Kinematic viscosity (40° C.) | | $Mm^2/s$ | 16.3 | 16.1 | 20.0 | 18.7 |
| Kinematic viscosity (100° C.) kv100 | | $Mm^2/s$ | 4.0 | 3.9 | 4.3 | 4.1 |
| Viscosity index | | | 145 | 144 | 123 | 121 |
| Solid point | | ° C. | −20 | −17 | −20 | −24 |
| $^{13}$C-NMR | CH | % | 6.4 | 6.8 | 9.7 | 7.4 |
| | $CH_3$ | % | 15.6 | 15.2 | — | — |
| | ϵ-Methylene proportion | % | 22.4 | 21.8 | 14.2 | 14.9 |
| Iodine number | | | 0.6 | 0.6 | 2.5 | 2.7 |
| Aniline point | | ° C. | 119.4 | 119.2 | 115.7 | 112.0 |
| CCS viscosity (−35° C.) | | mPa · s | 2740 | 2460 | 3000 | 3500 |
| NOACK evaporation (250° C., 1 hour) | | % by mass | 12.4 | 12.0 | 15.5 | 16.1 |

The results in Tables 3 and 4 demonstrate that the lubricating base oils of Examples 1 and 2 both had a superior low temperature viscosity property (CCS viscosity at −35° C.) compared to the lubricating base oils of Comparative Examples 1-4. Incidentally, base oil 3 and base oil 4 were lubricating base oils produced in the same manner as base oil 2 but using WAX2 as the starting material and performing solvent dewaxing at −20 to −23° C., and they satisfied the constituent features of the present application claim 1 except for aforementioned ϵ-methylene proportion exceeding 20% (20-24%) and exhibited properties roughly equivalent to those of base oil 2 or base oil 1, yet were satisfactorily superior with a high viscosity index of 140-150 and a −35° C. CCS viscosity of less than 3000 mPa·s (2200-2900 mPa·s).

Examples 3 and 4, Comparative Examples 5-8

For Examples 3 and 4 and Comparative Examples 5-8, lubricating oil compositions listed in Tables 5 and 6 were prepared using base oils 1-6 mentioned above, dispersant type polymethacrylate with PSSI of 40 and performance additives (including antioxidants, ashless dispersants, metallic detergents, anti-wear agents and the like). The properties of the obtained lubricating oil compositions are shown in Tables 5 and 6.

[NOx Absorption Test]

The lubricating oil compositions of Examples 3 and 4 and Comparative Examples 5-8 were each subjected to a NOx absorption test in the following manner. Following the method described in Proceedings of JAST (the Japanese Society of Tribologists) Tribology Conference, 1992, 10, 465, NOx-containing gas was blown into the test oil and the time-dependent change in acid number with forced aging was measured. The temperature for the test was 140° C., and the NOx concentration of the NOx-containing gas was 1200 ppm. The $O_2$ concentration was 85%. The increases in acid number after 144 hours from initial blowing in of NOx gas are shown in Tables 5 and 6. In the tables, a smaller acid number increase indicates a long drain oil capable of more prolonged use even in the presence of NOx used in internal combustion engines.

TABLE 5

| | | Example 3 | Example 4 |
|---|---|---|---|
| Base oil components [% by mass] | D1 | 100 | — |
| | D2 | — | 100 |
| Lubricating oil composition components [% by mass] | Base oil | Remainder | Remainder |
| | Performance additive | 10 | 10 |
| | PMA | 4 | 4 |
| Kinematic viscosity at 100° C. [$mm^2/s$] | | 8.5 | 8.5 |
| Viscosity index | | 212 | 220 |
| MRV viscosity at −40° C. [mPa · s] | | 7400 | 11600 |
| Acid number increase [mgKOH/g] | | 7.7 | 7.9 |

TABLE 6

| | | Comp. Ex. 5 | Comp. Ex. 6 | Comp. Ex. 7 | Comp. Ex. 8 |
|---|---|---|---|---|---|
| Base oil components [% by mass] | Base oil 3 | 100 | — | — | — |
| | Base oil 4 | — | 100 | — | — |
| | Base oil 5 | — | — | 100 | — |
| | Base oil 6 | — | — | — | 100 |
| Lubricating oil composition components [% by mass] | Base oil | Remainder | Remainder | Remainder | Remainder |
| | Performance additive | 10 | 10 | 10 | 10 |
| | PMA | 4 | 4 | 4 | 4 |
| Kinematic viscosity at 100° C. [$mm^2/s$] | | 8.6 | 8.5 | 8.9 | 8.7 |
| Viscosity index | | 224 | 224 | 203 | 200 |
| MRV viscosity at −40° C. [mPa · s] | | 29000 | 35900 | 12500 | 25500 |
| Acid number increase [mgKOH/g] | | 7.8 | 8.2 | 9.4 | 11.5 |

Based on the results in Tables 5 and 6, the lubricating oil compositions of Comparative Examples 5 and 6 exhibited sufficient low temperature performance with a −40° C. MRV viscosity of 60,000 mPa·s or lower, while their viscosity indexes were higher and their acid number increases in the presence of NOx were lower than the lubricating oil compositions of Comparative Examples 7 and 8. However, the lubricating oil compositions of Examples 3 and 4 clearly had a superior low temperature viscosity property (−40° C. MRV viscosity) compared to the lubricating oil compositions of Comparative Examples 5-8. Also, the lubricating oil compositions of Examples 3 and 4 had higher viscosity indexes and superior heat and oxidation stability compared to the lubricating oil compositions of Comparative Examples 7 and 8.

The invention claimed is:

1. A lubricating base oil having:

a saturated component content of 95% by mass or greater, a cyclic saturated component proportion which is measured based on ASTM D 2786-91 of no greater than 40% by mass of the saturated component, a viscosity index of 110 to 160, a kinematic viscosity at 100° C. of 3.7 to 4.5 $mm^2/s$, a kinematic viscosity at 40° C. of 13 to 19 $mm^2/s$, a solid point of −45 to −20° C., an iodine number of no greater than 2.5, a NOACK evaporation of 6 to 20% by mass, a ratio ($M_A/M_B$) between the mass of monocyclic saturated components ($M_A$) and the mass of bicyclic or greater saturated components ($M_B$) of the cyclic saturated components of no greater than 3, an aniline point of 106 or greater, a tertiary carbon proportion of 6 to 12% of the total constituent carbons, an ε-methylene proportion of 14 to 20% of the total constituent carbons, and an aromatic content of 0.4% by mass or greater.

2. The lubricating base oil according to claim 1, wherein bicyclic or greater polycyclic saturated components constitute no greater than 20% by mass of the saturated components.

3. The lubricating base oil according to claim 1, wherein an aromatic content is no greater than 5% by mass.

4. A lubricating oil composition comprising the lubricating base oil according to claim 1.

5. The lubricating base oil according to claim 1, wherein a −35° C. CCS viscosity of the base oil is less than 2800 mPa·s.

6. The lubricating base oil according to claim 1, wherein a −35° C. CCS viscosity of the base oil is less than 2000 mPa·s.

7. The lubricating base oil according to claim 1, wherein the base oil is obtained by hydrocracking and/or hydroisomerization of a stock oil comprising at least 50 vol % slack wax.

8. The lubricating base oil according to claim 1, wherein the base oil is obtained by hydrocracking and/or hydroisomerization of a stock oil comprising at least 50 vol % synthetic wax obtained by gas-to-liquid process.

9. The lubricating oil composition according to claim 4, wherein a −40° C. MRV viscosity is no greater than 30,000 mPa·s.

10. The lubricating oil composition according to claim 4, wherein a kinematic viscosity at 100° C. is 4.5 to 21.9 $mm^2/s$.

11. The lubricating oil composition according to claim 4, wherein a viscosity index is 160 or greater.

12. The lubricating base oil according to claim 1, wherein the ratio ($M_A/M_B$) is no greater than 2.

13. The lubricating base oil according to claim 12, wherein the ratio ($M_A/M_B$) is no greater than 1.

14. The lubricating base oil according to claim 1, wherein the aromatic content is 0.5% by mass or greater.

* * * * *